US007830077B2

(12) United States Patent
Ueno et al.

(10) Patent No.: US 7,830,077 B2
(45) Date of Patent: Nov. 9, 2010

(54) LIGHT-EMITTING DEVICE CONFIGURED TO EMIT LIGHT BY A CREEPING DISCHARGE OF AN EMITTER

(75) Inventors: Iwao Ueno, Kyoto (JP); Junichi Kato, Osaka (JP)

(73) Assignee: Panasonic Corporation, Osaka (JP)

( * ) Notice: Subject to any disclaimer, the term of this patent is extended or adjusted under 35 U.S.C. 154(b) by 284 days.

(21) Appl. No.: 11/910,622

(22) PCT Filed: Apr. 6, 2006

(86) PCT No.: PCT/JP2006/307347

§ 371 (c)(1),
(2), (4) Date: Oct. 4, 2007

(87) PCT Pub. No.: WO2006/109681

PCT Pub. Date: Oct. 19, 2006

(65) Prior Publication Data

US 2009/0236964 A1 Sep. 24, 2009

(30) Foreign Application Priority Data

Apr. 7, 2005 (JP) ..... 2005-110602
Aug. 22, 2005 (JP) ..... 2005-239343

(51) Int. Cl.
*H01J 1/62* (2006.01)
*H01J 63/04* (2006.01)

(52) U.S. Cl. ..... 313/483; 313/484; 313/485; 313/489

(58) Field of Classification Search ..... 313/582.586, 313/486, 483, 484, 485, 487, 489, 491, 492; 445/24; 345/60; 315/169.4; 257/109
See application file for complete search history.

(56) References Cited

U.S. PATENT DOCUMENTS 5,453,661 A 9/1995 Auciello et al.

(Continued)

FOREIGN PATENT DOCUMENTS

EP 1420435 A2 * 5/2004

(Continued)

OTHER PUBLICATIONS

Chinese Office Action for corresponding application No. 200680000316.4 issued Apr. 3, 2009.

(Continued)

*Primary Examiner*—Nimeshkumar D Patel
*Assistant Examiner*—Glenn Zimmerman
(74) *Attorney, Agent, or Firm*—Renner, Otto, Boisselle & Sklar, LLP

(57) ABSTRACT

A light-emitting device according to the present invention includes: first insulators (4) arranged so as to face each other; an emitter (2) arranged between the first insulators; a second insulator (5) functioning as a base for the first insulators and the emitter; an electrode (6) arranged to face, or contact with, the first insulators partially; another electrode (10) contacting with the second insulator and interposing the second insulator between the electrode and itself; and a light-transmitting substrate (8) that faces the second insulator with the first insulators interposed somewhere and with the emitter interposed elsewhere. If the first insulators are extended to reach the light-transmitting substrate on a cross section including the first and second insulators, the emitter and the light-transmitting substrate, the ratio of the cross-sectional area of the emitter to the combined cross-sectional area of the first and second insulators and the light-transmitting substrate is defined so as to fall within a predetermined range.

17 Claims, 7 Drawing Sheets

U.S. PATENT DOCUMENTS

| | | | | |
|---|---|---|---|---|
| 5,631,664 | A | 5/1997 | Adachi et al. | |
| 6,242,860 | B1 * | 6/2001 | Sasao et al. | 313/586 |
| 6,249,264 | B1 * | 6/2001 | Sano et al. | 345/60 |
| 6,285,129 | B1 * | 9/2001 | Park et al. | 313/586 |
| 6,540,576 | B1 | 4/2003 | Watanabe et al. | |
| 6,603,264 | B1 * | 8/2003 | Hirao et al. | 313/586 |
| 6,632,116 | B2 * | 10/2003 | Watanabe et al. | 445/24 |
| 7,541,733 | B2 * | 6/2009 | Ueno et al. | 313/502 |
| 2002/0036466 | A1 * | 3/2002 | Tanaka et al. | 313/586 |
| 2002/0180355 | A1 * | 12/2002 | Mori et al. | 313/582 |
| 2003/0137234 | A1 * | 7/2003 | Aoki et al. | 313/486 |
| 2004/0061442 | A1 | 4/2004 | Yuki et al. | |
| 2004/0183439 | A1 * | 9/2004 | Aoki et al. | 313/582 |
| 2005/0001550 | A1 * | 1/2005 | Shinoda et al. | 313/582 |
| 2005/0035715 | A1 * | 2/2005 | Kado et al. | 313/582 |
| 2005/0067957 | A1 | 3/2005 | Moon | |
| 2005/0174037 | A1 | 8/2005 | Ueno et al. | |
| 2007/0069235 | A1 | 3/2007 | Ueno et al. | |
| 2007/0205964 | A1 * | 9/2007 | Nagaki | 345/60 |

FOREIGN PATENT DOCUMENTS

| | | | |
|---|---|---|---|
| EP | 1 510 565 | | 3/2005 |
| JP | 06-283269 | | 10/1994 |
| JP | 7-64490 | | 3/1995 |
| JP | 08-083686 | | 3/1996 |
| JP | 2001-283734 | | 10/2001 |
| JP | 2001-312963 | | 11/2001 |
| JP | 2004-071434 | | 3/2004 |
| JP | 2004-200143 | | 7/2004 |
| JP | 2005-011743 | | 1/2005 |
| KR | 10-2004-0108268 | | 12/2004 |
| WO | WO 03097769 | A1 * | 11/2003 |
| WO | WO 2004016049 | A1 * | 2/2004 |
| WO | WO 2005051045 | A1 * | 6/2005 |
| WO | WO 2005101358 | A1 * | 10/2005 |

OTHER PUBLICATIONS

Shoichi Matsumoto et al.; "Electronic Display Device"; Ohmsha Ltd., Dec. 25, 1984; pp. 147-151. Partial English translation provided.

International Search Report for corresponding Application No. PCT/JP2006/307347 dated Jun. 27, 2006.

Shoichi Matsumoto et al.; "Electronic Display"; Ohmsha Ltd., Jul. 7, 1995; pp. 147-151.

Junichi Asano et al.; "Field-Excited Electron Emission from Ferroelectric Ceramic in Vacuum"; Japanese Journal of Applied Physics; vol. 31, Part 1; pp. 3098-3101; Sep. 1992.

European Search Report for corresponding Application No. RS 112917 (JP 2005-239343) dated Nov. 17, 2005.

* cited by examiner

*FIG. 1 2* CONVENTIONAL ART
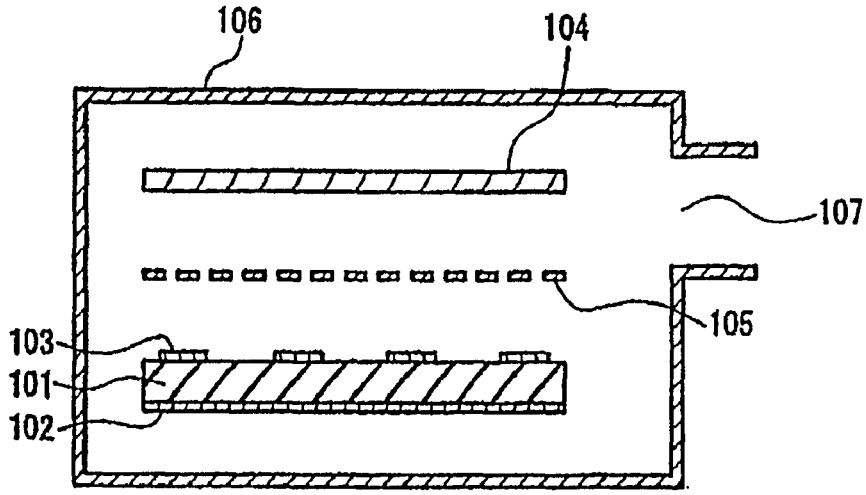
*FIG. 1 3* CONVENTIONAL ART
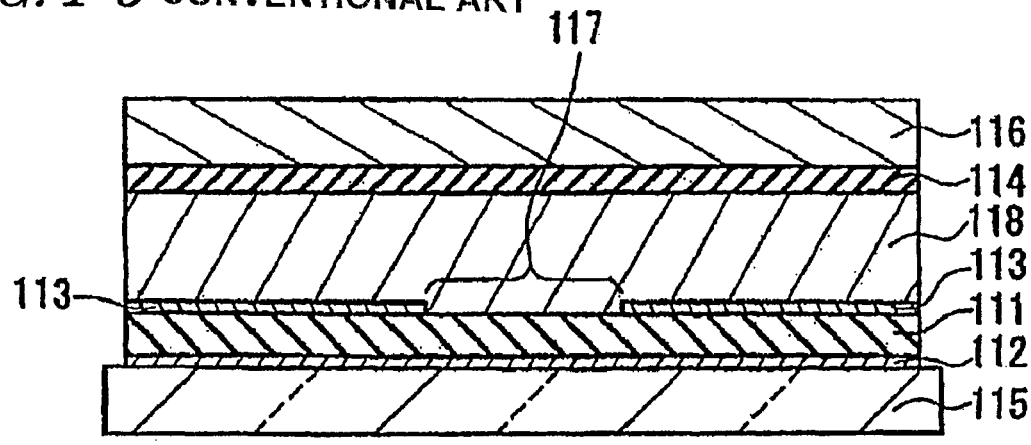

LIGHT-EMITTING DEVICE CONFIGURED TO EMIT LIGHT BY A CREEPING DISCHARGE OF AN EMITTER

TECHNICAL FIELD

The present invention relates to a light-emitting device, and more particularly relates to a light-emitting device constituting a unit pixel for a flat display that has a simple configuration, can be fabricated easily, and achieves high efficiency.

BACKGROUND ART

Light-emitting devices have been researched and developed more and more extensively these days to find applications in various types of displays including electro-luminescence displays (ELD), plasma displays (PDP) and field emission displays (FED), among other things, and eventually realize displays with even higher image quality and even higher efficiency. Taking an ELD and an FED as examples, Non-Patent Document No. 1 outlines an ELD as follows. One example is an ELD having a basic structure of applying an electric field to a fluorescent material, which is a light-emitting layer, via an insulating layer. Known ELDs with such a structure are classified into organic dispersion types and thin film types. An organic dispersion type has a structure in which ZnS particles, doped with Cu, for example, are dispersed in an organic substance, an insulating layer is deposited thereon, and the assembly is sandwiched between top and bottom electrodes. The dopant forms a pn junction in the fluorescent particles. When an electric field is applied, electrons emitted by a high electric field generated on the junction planes are accelerated and then recombined with holes to emit light. Another example has a structure in which a fluorescent thin film, made of Mn-doped ZnS, for example, which is a light-emitting layer, is arranged between electrodes with insulating layers interposed. Since the insulating layers are interposed, a high electric field can be applied to the light-emitting layer, and the emitted electrons accelerated by the electric field excite the emission centers to emit light. FED, on the other hand, includes an electron emission device and a fluorescent material that faces the device in a vacuum container. The FED accelerates electrons, emitted into a vacuum by the electron emission device, and bombards the fluorescent layer with the electrons, thereby emitting light.

In each of these devices, the emission of electrons triggers the emission of light, and therefore, it is important to develop a technique to emit electrons at a low voltage and with high efficiency. As such a technique, emission of electrons by inverting the polarization of ferroelectrics has attracted a lot of attention lately. For example, Non-Patent Document No. 2 proposes that PZT ceramic 101, having a plane electrode 102 on one side and a lattice electrode 103 on the other side, be arranged so as to face a platinum electrode 104 with a grid electrode 105 interposed between them in a vacuum container 106 and that a pulse voltage be applied between the electrodes to emit electrons as shown in FIG. 12, in which the reference numeral 107 denotes a gas outlet port. According to this proposal, the pressure in the container is 1.33 Pa ($10^{-2}$ Torr), and discharge does not occur at the atmospheric pressure.

Such a method of emitting light from a fluorescent layer by accelerating electrons, emitted by inverting polarization of ferroelectrics, in a vacuum container and, and a display using such an emission technique are also disclosed in Patent Documents Nos. 1 and 2. However, the basic arrangement is almost the same except that light is emitted from a fluorescent layer by replacing the platinum electrode of Non-Patent Document No. 2 with an electrode including the fluorescent layer.

On the other hand, a light-emitting device that uses electrons emitted by inverting the polarization of ferroelectrics in a non-vacuum is disclosed as an electric emission surface light source device in Patent Document No. 3, for example. As shown in FIG. 13, the device includes a bottom electrode 112, a ferroelectric thin film 111, a top electrode 113, a carrier multiplication layer 118, an emission layer 114, and transparent electrode 116, which are stacked in this order on a substrate 115, and the top electrode has an opening 117. By inverting a voltage pulse applied between the bottom and top electrodes, electrons are emitted into the carrier multiplication layer through the opening of the top electrode, accelerated by the positive voltage applied to the transparent electrode, reach the emission layer while being multiplied, and emit light. Patent Document No. 3 also discloses that the carrier multiplication layer is made of a semiconductor, of which the dielectric constant is relatively low and which has such a band gap as not to absorb the emission produced by the emission layer at a particular wavelength. This device may be regarded as a type of ELD. Meanwhile, Patent Document No. 4 discloses an arrangement in which an emission layer of a fluorescent substance that has been formed by a sputtering process is sandwiched between two insulating layers and a pulse electric field is applied thereto and in which one of the two insulating layers is a ferroelectric thin film.

The applicant of the present patent application also proposed an inexpensive flat light-emitting device with a simple configuration in Patent Document No. 5. In that light-emitting device, a voltage is applied to two electrodes that are arranged in contact with the surface of a porous emitter to cause electrical discharge. And fluorescent particles in the porous emitter are excited with an ultraviolet ray produced as a result of this electrical discharge, thereby emitting light. The applicant of the present patent application further disclosed a plasma display panel in Patent Document No. 6, in which barriers that define an electrical discharge space have different heights in column and row directions in order to avoid accidental electrical discharge and to increase the luminance.

Patent Document No. 1: Japanese Patent Application Laid-Open Publication No. 07-064490

Patent Document No. 2: U.S. Pat. No. 5,453,661

Patent Document No. 3: Japanese Patent Application Laid-Open Publication No. 06-283269

Patent Document No. 4: Japanese Patent Application Laid-Open Publication No. 08-083686

Patent Document No. 5: Japanese Patent Application Laid-Open Publication No. 2004-200143

Patent Document No. 6: Japanese Patent Application Laid-Open Publication No. 2005-011743

Non-Patent Document No. 1: Shoichi Matsumoto, et al, "Electronic Display", Ohmsha Ltd., Jul. 7, 1995, pp. 147-151.

Non-Patent Document No. 2: Junichi Asano, et al, "Field-Excited Electron Emission from Ferroelectric Ceramic in Vacuum", Japanese Journal of Applied Physics, Vol. 31, Part 1, pp. 3098-3101, September 1992

DISCLOSURE OF INVENTION

Problems to be Solved by the Invention

Examples of important parameters that determine the value of a superior light-emitting device include the level and stability of luminance, high efficiency, high definition, durability, the ability to contribute to reducing the thickness and applicability to a huge-screen display. In the conventional devices described above, the current PDPs could barely cope with those demands for high efficiency and high definition, and ELD still has a lot of technical problems in terms of applicability to huge-screen displays, durability and simplification of the manufacturing process.

Particularly for PDPs, which have recently been rapidly developed and put on the market one after another, PDPs must go through a lot of process steps before the fluorescent material gets ready to emit light, and achieves poor luminous efficacy. The problem is their light emission principle. Specifically, first, plasma discharge needs to be produced by applying voltage to xenon gas or neon gas in the light-emitting device. And fluorescent material applied on the inner wall of the light-emitting device is excited by the ultraviolet radiation produced by this plasma discharge, and red, green and blue lights are emitted. Due to their emission principle, PDPs have such an essential problem that a lot of process steps must be gone through before the fluorescent material is ready to emit light. That is why it is difficult for PDPs to achieve high luminous efficacy or to avoid dissipating a lot of power when applied to a huge-screen display.

On top of that, to get light emitted in a PDP, the cell structure is naturally subject to various constraints. For example, ample space is needed to produce electrical discharge in a gas such as xenon. The emitter should also be to thick enough to include a good number of centers of emission for transforming ultraviolet radiation into visible radiation and to output the visible radiation through the front facet. However, the emitter may not be too thick or too thin in order to secure a sufficient space for electrical discharge. That is to say, the thickness of the emitter needs to be controlled so as to fall within an appropriate range, which would never leave a lot of flexibility in designing its manufacturing process. Also, a gas such as xenon needs to be injected airtight after the light-emitting device has been evacuated, which would require bulky manufacturing equipment and would increase the cost significantly. Also for the reasons mentioned above, PDP tends to be vulnerable to impacts.

Considering the configuration of the light-emitting device to be applied to a display, on the other hand, there are various technical problems that must be overcome to provide a new type of display that would replace a PDP. Examples of those problems include selection of a material for the barriers forming a cell, appropriate arrangement of the barriers with respect to electrodes, and effects of the position and thickness of the emitter. Therefore, the aforementioned technology, disclosed by the applicant of the present application, may propose something that could be applied to displays in the future, but nothing on the configuration of a specific light-emitting device, e.g., a specific cell structure, among other things.

In order to overcome the problems described above, the present invention has an object of providing a method for forming a light-emitting device structure for displays that would increase not only processability but also productivity significantly by making it very easy to control its manufacturing process. Another object of the present invention is to provide a light-emitting device, of which the luminance is at least approximately equal to, or even higher than, those of PDPs and ELDs of various types and which would achieve such high efficiency and high definition as to potentially find applications in huge-screen displays in the near future.

Means for Solving the Problems

The present inventors conducted extensive research into a light-emitting device that would achieve high luminance and high efficiency while relaxing various constraints on the device structure adopted in conventional PDPs. As a result, we discovered that if an emitter including fluorescent particles was interposed between selected insulators on a predetermined insulating substrate and if at least two electrodes were arranged at predetermined positions to apply a voltage thereto, light was emitted even in the air and the luminance varied when the thicknesses of the emitter were changed. And while carrying on our research even further, we also discovered that the emission status of the emitter changed according to the positions of those two electrodes and the dielectric constant of the insulator. Consequently, the present inventors determined an appropriate range in which the light-emitting devices could be applied to various types of displays and mass-producible on a commercial basis, thereby perfecting our invention.

A light-emitting device according to the present invention includes: a first insulator, including a plurality of portions that are arranged so as to face each other; an emitter, which includes fluorescent particles and which is arranged in a space that is defined by those portions of the first insulator; a second insulator, which functions as a base for the first insulator and the emitter; a plurality of electrodes to generate an electric field in the space; and a substrate, which faces the second insulator with the emitter interposed between them. If the first insulator is extended to reach the substrate on a plane that is viewed perpendicularly to the surface of the second insulator and that passes the center of the space, the ratio A2/A1 of the cross-sectional area A2 of the emitter to the cross-sectional area A1 of a range surrounded with the first and second insulators and the substrate is greater than 0.4 but less than 1. This A2/A1 ratio preferably exceeds 0.5.

By adopting this configuration, the thickness of the emitter being applied can be controlled more easily and the productivity and production yield will improve. It was quite impossible for any conventional light-emitting device to provide an appropriately wide range, or a sufficiently broad process margin, for this thickness. This is because the emission mechanism of light-emitting devices is totally different from that of PDPs, which require a predetermined electrical discharge space. That is to say, the present inventors propose a composite mechanism in which light is emitted by being excited with an ultraviolet ray to be produced when electrons emitted from electrodes collide against gas molecules or gas atoms and in which light is also emitted when the center of emission is excited with the electrons that have been emitted from electrodes and have collided against the surface of fluorescent particles. Also, if the configuration of the present invention is adopted, there is no need to introduce a substitute rare gas unlike PDPs, which would also contribute to simplifying the manufacturing process. According to the present invention, the "transparent substrate" is typically a glass substrate, but does not have to be made of glass. For example, a flexible resin substrate made of an acrylic resin may also be used substantially without diminishing the effect of the present invention.

In any of the light-emitting devices mentioned above, an embodiment in which the first and second insulators are made of the same material is never excluded but rather preferred in order to simplify the manufacturing process or increase the mechanical strength. This is because in that case, the first and second insulators could be formed together as an integral member by a sandblast process, for example. Also, the effect of the present invention will manifest itself if the first and second insulators have a dielectric constant of 5 or more. As far as the dielectric constant is concerned, it is more preferred that one of the first and second insulators has a dielectric constant of 30 or more and the other insulator has a dielectric constant of 5 or more. Even more preferably, one of the first and second insulators has a dielectric constant of 100 or more and the other insulator has a dielectric constant of 30 or more. Furthermore, for any of the light-emitting devices described above, those portions of the first insulator that are arranged so as to face each other may naturally be a pair of insulators with a rectangular parallelepiped shape. Alternatively, the first insulator may also have a column structure with a trapezoidal cross section as is adopted in preferred embodiments of the present invention to be described later. Furthermore, for any of the light-emitting devices described above, the light-transmitting substrate refers to a substrate arranged at the outermost position of the light-emitting device, not to a light-transmitting film or layer covering the electrode. "At least one electrode that either faces or contacts with the first insulator at least partially" refers to not only an embodiment in which the electrode is arranged on the light-transmitting substrate and contacts or faces the first insulator partially but also an embodiment in which the electrode is put on the first insulator and contacts or faces the light-transmitting substrate partially as well.

The insulating metal oxide used as the first and second insulators is preferably made of either a glass material or a mixture of a glass material and a metal oxide. This is because a mixture including a glass material would be easier to form into an intended shape, which is advantageous in making huge-screen displays. Examples of specific materials include not only glass materials but also $Y_2O_3$, $Li_2O$, MgO, CaO, BaO, SrO, $Al_2O_3$, $SiO_2$, $MgTiO_3$, $CaTiO_3$, $BaTiO_3$, $SrTiO_3$, $ZrO_2$, $TiO_2$, $B_2O_3$, $Pb(Zr, Ti)O_3$ and $PbTiO_3$, at least one of which may be used either by itself or in combination. No matter which of these insulators is selected, the effect of the present invention will show up clearly if the mixture ratio is determined such that the dielectric constant becomes equal to or greater than the predetermined value described above. The glass material is preferably so-called "low-melting glass" such as borosilicate glass, of which the glass transition temperature is 600° C. or less, because the manufacturing process would be facilitated in that case.

The at least one electrode that either faces or contacts with the first insulator at least partially is preferably covered with an insulating layer in order to increase the durability of the electrode. Furthermore, the insulating layer preferably includes an alkaline earth metal oxide. This is because such a layer would protect the electrode from the impact of electrons and ions and would eventually increase the durability of the device overall. More specifically, the insulating layer preferably includes at least one material selected from the group consisting of $Y_2O_3$, $Li_2O$, MgO, CaO, BaO, SrO, $Al_2O_3$, $SiO_2$, $MgTiO_3$, $CaTiO_3$, $BaTiO_3$, $SrTiO_3$, $ZrO_2$, $TiO_2$, $B_2O_3$, $Pb(Zr, Ti)O_3$ and $PbTiO_3$.

In any of the light-emitting devices described above, it is preferable that the surface layer of the emitter is porous. If a predetermined voltage is applied between either two electrodes that sandwich the emitter or two electrodes arranged on one side of the emitter, a so-called "creeping discharge" phenomenon that electrons flow through the emitter will occur. It should be noted that the "creeping discharge" is sometimes called "surface discharge", which is quite different from the surface discharge phenomenon in the field of PDPs. Specifically, the surface discharge in the field of PDPs means electrical discharge that is produced between electrodes provided for a front-side panel, whereas the creeping discharge will refer herein to electrical discharge that is produced either on the surface layer of the emitter or inside a porous emitter.

If the surface layer of the emitter is porous, the creeping discharge will occur there like an avalanche and will last a while, thus stabilizing the luminance. Furthermore, if the entire emitter is porous, then the creeping discharge will occur not just on the surface, but also inside, of the porous emitter, and light can be emitted from the centers of emission in the fluorescent particles more efficiently. That is why this embodiment is even more preferable. The fluorescent particles may be spherical, needle-like, whisker-like or plate-like ones. In any case, if the emitter is formed by compacting powder particles, a porous status can be more easily created eventually.

In any of the light-emitting devices described above, a gas is preferably present between the emitter and the at least one electrode that either faces or contacts with the first insulator at least partially, and the gas preferably includes at least oxygen or nitrogen. Since emission of light is not affected even if the gas includes oxygen or nitrogen, gas substitution is substantially unnecessary. On top of that, the display can be fabricated more easily and in a shorter time, which are advantages. Also, the gas preferably includes at least oxygen or nitrogen, and the total of oxygen and nitrogen preferably accounts for at least 1 vol % of the gas. Even if gas includes 1% or more of oxygen and nitrogen, the light-emitting device of the present invention can still emit light without decreasing its luminance. Furthermore, the gas preferably includes at least oxygen or nitrogen and xenon gas preferably accounts for 2 vol % or less of the gas. Even if the gas includes 2% or less xenon, emission of light is still possible without diminishing the effect of the present invention. In this way, the light-emitting device of the present invention does not have to change gases using an airtight system as is required by a PDP, and strict control of the gas is not required in the manufacturing process of the display and the overall manufacturing process time can be shortened, all of which are beneficial. Optionally, it is not impossible to use a rare gas as an electrical discharge gas. The rare gas may be used to decrease the electrical discharge voltage. The gas preferably has a pressure of $5\times10^3$ Pa to $9\times10^4$ Pa.

In one preferred embodiment, each portion of the first insulator has a rib structure that protrudes from the second insulator toward the substrate.

In another preferred embodiment, those portions of the first insulator define barriers that divide a plurality of self-emitting cells from each other between the second insulator and the substrate.

In this particular preferred embodiment, a gap is left between the barriers and the substrate.

Another light-emitting device according to the present invention includes: two substrates, at least one of which transmits light; a plurality of cells, which are interposed between the two substrates and each of which emits light; and an electrode structure for applying a voltage to each of those cells. Each of the cells includes an emitter layer including a fluorescent substance and a gas layer. When a voltage is applied to the electrode structure, electrical discharge is produced in the gas layer and electrons collide against the fluorescent substance, thereby emitting light by electron excitation.

In one preferred embodiment, the ratio of that volume of the emitter to the combined volume of the gas layer and the emitter in each cell is greater than 0.4 but smaller than 1.

In another preferred embodiment, the average thickness of the gas layer is smaller than that of the emitter in each cell.

EFFECTS OF THE INVENTION

The light-emitting device of the present invention includes an emitter, accounting for a greater volume percentage than the gas layer, and therefore, can emit light using not only the radiation produced by the electrical discharge of the gas layer but also the creeping discharge of the emitter, thus achieving higher luminance. In addition, according to the present invention, a broader margin is allowed for a variation in the thickness of the emitter and restriction on the gas layer's electrical discharge conditions are also relaxed. As a result, the emitter can be made by adopting thick film process technologies and the gas layer could be the air, too.

Consequently, according to the present invention, the manufacturing process can be simplified, the productivity can be improved, and a quality display device can be provided at a reduced cost. The light-emitting device of the present invention achieves luminance that is at least almost as high as, and even higher than, that of PDPs or ELDs, and would contribute immensely to further reducing the thickness, increasing the screen size, and raising the definition of those displays.

BRIEF DESCRIPTION OF DRAWINGS

FIG. 10 is a cross-sectional view of the light-emitting device as viewed on the plane A-A shown in FIG. 1.

FIG. 11 is a plan view of the light-emitting device depicting the light-emitting device of the first preferred embodiment of the present invention.

FIG. 12 is a conventional light-emitting device as disclosed in Non-Patent Document No. 2.

FIG. 13 is a conventional light-emitting device as disclosed in Non-Patent Document No. 3.

DESCRIPTION OF REFERENCE NUMERALS

Figure 1:
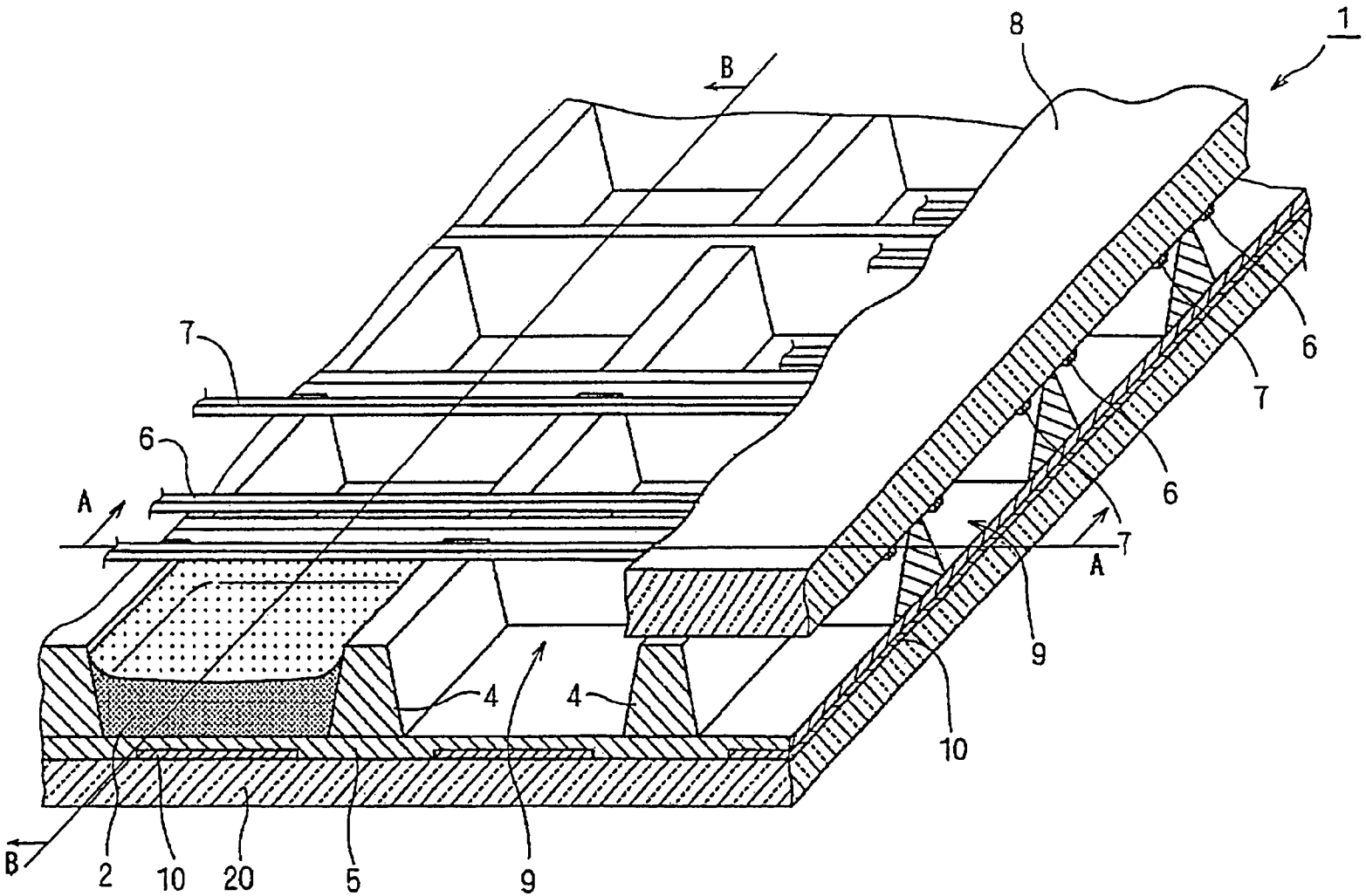
FIG. 1 is a perspective view depicting a light-emitting device according to a first preferred embodiment of the present invention.

1 light-emitting device
2 emitter including fluorescent particles
4 first insulator
5 second insulator
6 first electrode
7 second electrode
8 light-transmitting substrate
9 gas layer
10 third electrode
11 insulating layer
20 lower substrate

BEST MODE FOR CARRYING OUT THE INVENTION

Hereinafter, preferred embodiments of the present invention will be described with reference to the accompanying drawings. First, the structure of a light-emitting device according to a first specific preferred embodiment of the present invention will be described with reference to FIGS. 1 through 5.

FIG. 1 is a perspective view depicting a light-emitting device according to a first preferred embodiment of the present invention. FIGS. 2 to 5 are views illustrating respective manufacturing process steps to make the light-emitting device of the first preferred embodiment. In these drawings, the reference numeral 1 denotes a light-emitting device, 2 denotes an emitter including fluorescent particles, 4 denotes a first insulator, 5 denotes a second insulator, 6 denotes a first electrode (which will also be referred to herein as a "first front-side electrode"), 7 denotes a second electrode (which will also be referred to herein as a "second front-side electrode"), 8 denotes a light-transmitting substrate, 9 denotes a gas layer, 10 denotes a third electrode (which will also be referred to herein as a "back-side electrode"), and 20 denotes a lower substrate. FIG. 10 is a cross-sectional view of the device as viewed on plane A-A shown in FIG. 1, which clearly shows the arrangement of the first insulator 4 and the gas layer 9 with respect to the respective electrodes 6 and 7 on the light-transmitting substrate 8 among other things. FIG. 11 is a plan view of the light-emitting device of the first preferred embodiment. In FIG. 1, only a portion of the light-transmitting substrate 8 is shown for convenience sake. The electrodes 6 and 7 are shown for only two columns of light emitting cells as counted from the front side of the drawing so as to make clearly understandable the arrangement of the electrodes with respect to the other members of the device. It should be noted that as this cross-sectional view is viewed on a plane located between the first and second electrodes 6 and 7, the first electrode 6 located at the front end of this drawing is not shown.

Figure 2:
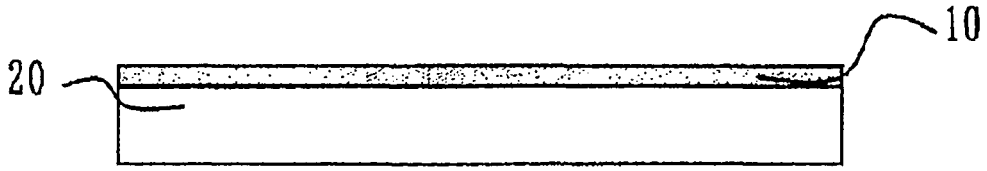
FIG. 2 is a view illustrating a manufacturing process step to make the light-emitting device of the first preferred embodiment.
Figure 3:
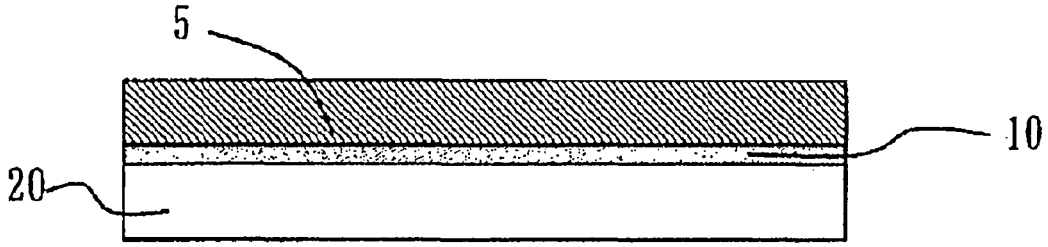
FIG. 3 is a view illustrating another manufacturing process step to make the light-emitting device of the first preferred embodiment.

As shown in FIG. 2, on one side of the lower substrate 20, made of a glass material, a ceramic material or a mixture of a glass material and a ceramic material, for example, Ag paste is baked and deposited to a thickness 5 μm to 30 μm, thereby forming a third electrode 10 in a predetermined shape. Then, as shown in FIG. 3, the second insulator 5 is deposited on the lower substrate 20 and the third electrode 10. Specifically, paste is prepared by compounding a mixture of 40 wt % of $BaTiO_3$ power and 15 wt % of glass powder with 40 wt % of α-terpineol and 5 wt % of ethylcellulose. Then, the paste is screen-printed and then thermally treated at a temperature of 400° C. to 600° C. in the air, thereby forming a layer of the second insulator 5 with a thickness of 10 μm to 1,000 μm. Alternatively, a sheet on which the insulator has been deposited and laid bare and another sheet on which the electrode has been printed may be stacked in this order on the lower substrate 20 so that the second insulator surrounds the third electrode 10.

In this preferred embodiment, $BaTiO_3$ is used as the second insulator 5. However, the same effect would be achieved even if an insulator such as $SrTiO_3$, $CaTiO_3$, $MgTiO_3$, $Pb(Zr, Ti)O_3$ or $PbTiO_3$ is used. Also, when an insulator such as $Al_2O_3$, MgO or $ZrO_2$ was used, a similar effect was achieved but the luminance decreased compared to a situation where an insulator with a high relative dielectric constant was used. Nevertheless, such a decrease in luminance could be compensated for by increasing the capacitance with the thickness of the insulator reduced. An insulating layer may also be formed by a thin film deposition process such as a sputtering process, a CVD process, an evaporation process or a sol-gel process.

If a sintered body is used as the second insulator 5, the second insulator 5 may serve as the lower substrate 20. In that case, the lower substrate 20 may be omitted. The thickness of the insulator 5 would change significantly if a sintered body were used or if a thick film deposition process were adopted. Actually, the required capacitance may be adjusted with respect to the relative dielectric constant. Also, no matter whether or not the second insulator 5 serves as the lower substrate, the effect of the present invention can be achieved if the third electrode 10 contacts with a side of the insulator that faces the lower substrate or if the third electrode 10 is covered with the insulator 5.

Figure 4:
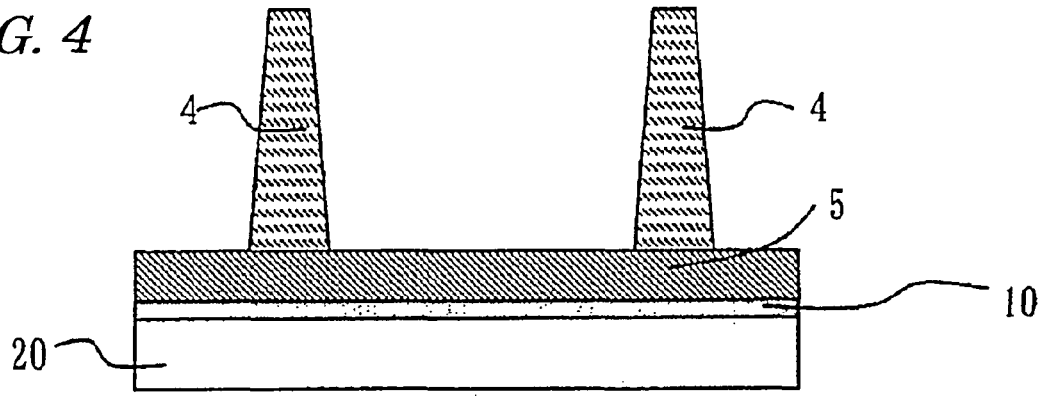
FIG. 4 is a view illustrating still another manufacturing process step to make the light-emitting device of the first preferred embodiment.

Then, the first insulator 4 is deposited on the second insulator 5 such that multiple portions of the first insulator 4 face each other. Specifically, paste is prepared by compounding 50 wt % of α-terpineol with 50 wt % of ceramic (e.g. $SrTiO_3$) and glass (having a weight ratio of one to one) mixed particles. Next, the paste is screen-printed in a predetermined pattern, and then thermally treated and solidified at a temperature of 400° C. to 580° C. for 2 to 5 hours, thereby depositing the first insulator 4 to a thickness of about 3 μm to about 500 μm as shown in FIG. 4. Optionally, the first and second insulators 4 and 5 may be made of the same material (e.g. $BaTiO_3$). If a same material is used, the first and second insulators 4 and 5 can be deposited at a time by a sandblasting process after predetermined areas have been masked. As a result, the number of manufacturing process steps can be cut down.

As shown in FIG. 1, those portions of the first insulator 4 have a rib structure that protrudes from the second insulator 5 toward the light-transmitting substrate 8 and define barriers that divide a plurality of self-emitting cells from each other between the second insulator 5 and the light-transmitting substrate 8 as shown in FIG. 1. The top of the first insulator 4 functioning as such barriers do not have to contact with the light-transmitting substrate 8. Rather, the height of the first insulator 4 may be set so as to intentionally leave a gap between the first insulator 4 and the light-transmitting substrate 8. In a situation where the light-transmitting substrate 8 has a huge area, however, if the height of the first insulator 4 varies from one point on the plane to another, the first insulator 4 may be in contact with the light-transmitting substrate 8 at one location but may be out of contact with the substrate 8 and leave a gap between them instead at another location. In that case, the electrical discharge state would be more likely to change from one cell to another. That is why to increase the uniformity of the electrical discharge state on a given plane, the height of the first insulator 4 is preferably set relatively low so as to leave a gap between the first insulator 4 and the light-transmitting substrate 8 everywhere on that plane. Nevertheless, to maintain the degree of planarity of the light-transmitting substrate 8, which would normally warp easily, sufficiently high, the first insulator 4 may have a locally increased height so as to contact with only selected portions of the light-transmitting substrate 8.

As shown in FIG. 1, those portions of the first insulator 4 are arranged in columns and rows on the second insulator 5 so as to form an array of cells in the shape of a waffle pan, so to speak. However, the present invention is in no way limited to this specific preferred embodiment. Alternatively, the first insulator may also have a structure defining either a striped pattern or a meandering pattern. Likewise, the bottom shape of the cells does not have to be rectangular, either, but may also have either a hexagonal shape or any other polygonal shape or even a curved shape.

Figure 5:
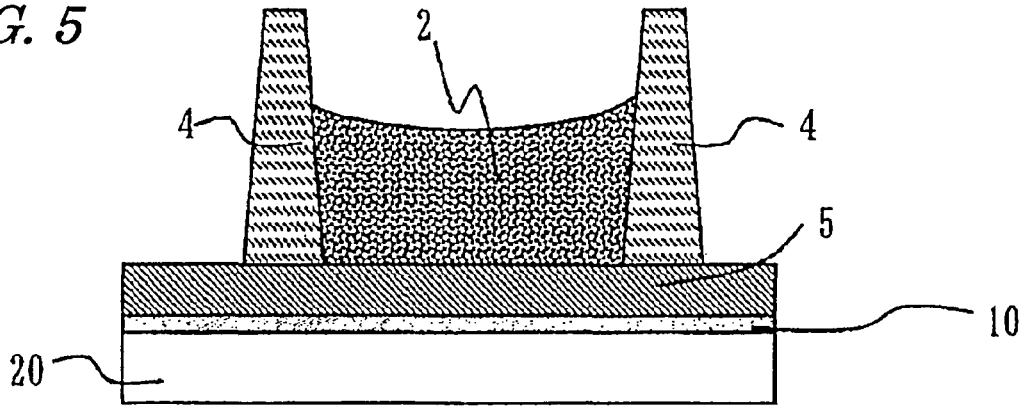
FIG. 5 is a view illustrating yet another manufacturing process step to make the light-emitting device of the first preferred embodiment.

Then, as shown in FIG. 5, a layer of an emitter 2 including fluorescent particles is formed on the second insulator 5 by a screen printing process. A paste is prepared for each emitter by compounding 45 wt % of α-terpineol and 5 wt % of ethylcellulose with 50 wt % of fluorescent particles, and then screen-printed and dried. By repeatedly performing this series of process steps a number of times, the thickness of the resultant emitter 2 is controlled so as to fall within the range of 3 μm to 500 μm as shown in FIG. 5. As the fluorescent particles, fluorescent materials for CRTs such as ZnS: Ag (blue), $ZnSiO_5$: $Ce^{3+}$ (blue), ZnS: Cu, Cl (green), (Y, Gd) $BO_3$: $Tb^{3+}$ (green), and $Y_2O_2S$: $Eu^{3+}$ (red) and inorganic compounds of fluorescent materials for lamps such as $BaMgAl_{10}O_{17}$: $Eu^{2+}$ (blue), $(Sr, Ba, Ca, Mg)_{10}(PO_4)_6Cl_2$: $Eu^{2+}$ (blue), $Zn_2SiO_4$: $Mn^{2+}$ (green), $Sr_4Al_{14}O_{25}$: $Eu^{2+}$ (green), $LaPO_4$: $Ce^{3+}$, $Tb^{3+}$ (bluish-green), $CeMgAl_{10}O_{19}$: $Tb^{3+}$ (green), 3.5 MgO.0.5 $MgF_2GeO_2$: $Mn^{4+}$ (red) and $YBO_3$: $Eu^{3+}$ (red) may be used.

In this preferred embodiment, the surface of the fluorescent particles may be coated with a layer of a metal oxide such as MgO. Then, the creeping discharge can be produced efficiently and the fluorescent particles can be protected from the impact of ions. An MgO layer may be formed on the surface of the fluorescent particles in the following manner, for example. First, a solution including $Mg(OC_2H_5)_2$ powder (1 molar ratio), which is a metal alkoxide, $CH_3COOH$ (10 molar ratio), $H_2O$ (50 molar ratio) and $C_2H_5OH$ (50 molar ratio), is stirred up and mixed well at room temperature to prepare an almost transparent sol-gel solution. Then, fluorescent particles (2 molar ratio) are added little by little to this sol-gel solution and stirred up together. This series of process steps is continued for one day. Thereafter, the mixed solution is subjected to a centrifugal separation. The resultant powder is put in a ceramic vat, and then dried at 150° C. for one whole day. After that, the dried powder is calcined at a temperature of 400° C. to 600° C. in the air for 2 to 5 hours, thereby forming a uniform layer of MgO on the surface of the fluorescent particles.

The emitter 2 is formed so as to emit light in red (R), green (G) or blue (B). In an actual display device, a layer of the emitter 2 is printed in a predetermined pattern (e.g. in stripes) for each one of the emission colors after another, thereby forming an emitter 2 in which such patterns are arranged regularly. Alternatively, an emitter 2 that can emit white light may be once formed, and then the white light may be separated into respective colors with color filters such that emission in a desired color can be obtained.

After the emitter 2 has been printed in this manner, a heat treatment is conducted at about 600° C. for 10 to 60 minutes in the air, thereby setting the thickness of the emitter 2 within the range of 3 μm to 500 μm. In this preferred embodiment, the emitter 2 is formed after the first insulator 4 has been deposited. However, the emitter 2 may also be formed earlier than the first insulator 4.

The paste described above was prepared by adding an organic binder or an organic solvent to the fluorescent particles. However, the same effect was achieved even when a paste was prepared by adding a colloidal silica aqueous solution to the fluorescent particles. It should be noted that if the colloidal silica aqueous solution is added, there is no need to conduct a heat treatment in the process step of forming the emitter, and therefore, oxidation of the fluorescent material can be reduced more significantly.

After the first insulator 4 has been deposited as described above, the emitter 2 is covered with a light-transmitting substrate 8 of glass, for example, thereby completing the light-emitting device of the first preferred embodiment shown in FIG. 1. On the light-transmitting substrate 8, the first and second electrodes 6 and 7 of Ag have already been arranged at such locations as to physically contact with the first insulator 4 at least partially when mounted on the emitter 2. In this process step, the light-transmitting substrate 8 is bonded onto the first insulator 4 with colloidal silica, water glass or resin such that a gap will be left as a gas layer 9 at least between the emitter 2 and the first electrode 6 or between the emitter 2 and the second electrode 7.

The distance between the emitter 2 and the first electrode 6 or between the emitter 2 and the second electrode 7, where the gas layer 9 is present, may be at least as long as the mean free path of the gas molecules. Therefore, the actual thickness of the emitter 2 preferably falls within the range of 20 μm to 500 μm to facilitate the manufacturing process, more preferably within the range of more than 30 μm to 250 μm. In the light-emitting device of this preferred embodiment, the discharge start voltage changes with the distance between each electrode 6 or 7 and the emitter 2. That is why if the upper limit of these ranges were exceeded, then it would be difficult to control the distance as intended during the manufacturing process, and the discharge start voltage would vary much more significantly.

As the light-transmitting substrate 8 including transparent electrodes of Ag as the first and second electrodes 6 and 7, a light-transmitting substrate with ITO interconnects, not Ag, may also be used. ITO has much higher electrical resistance than Ag. For that reason, care should be taken of increase in emission voltage, heat generation and disconnection. Examples of alternative electrode materials include gold, copper, titanium and aluminum.

Figure 6:
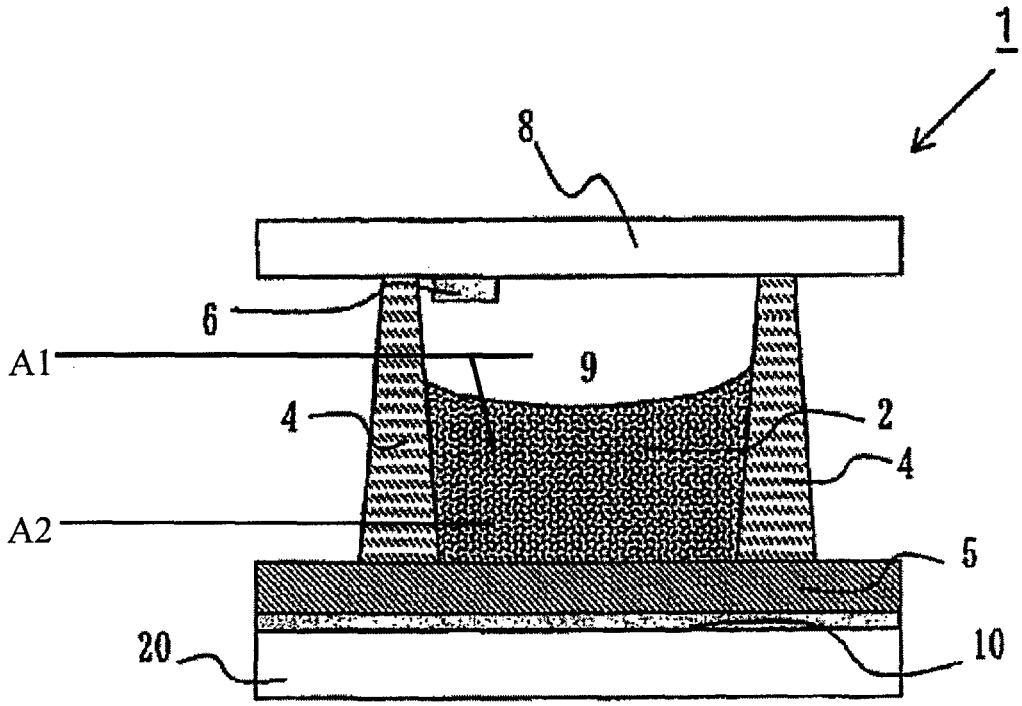
FIG. 6 is a cross-sectional view illustrating a light-emitting device according to a second preferred embodiment of the present invention.
Figure 7:
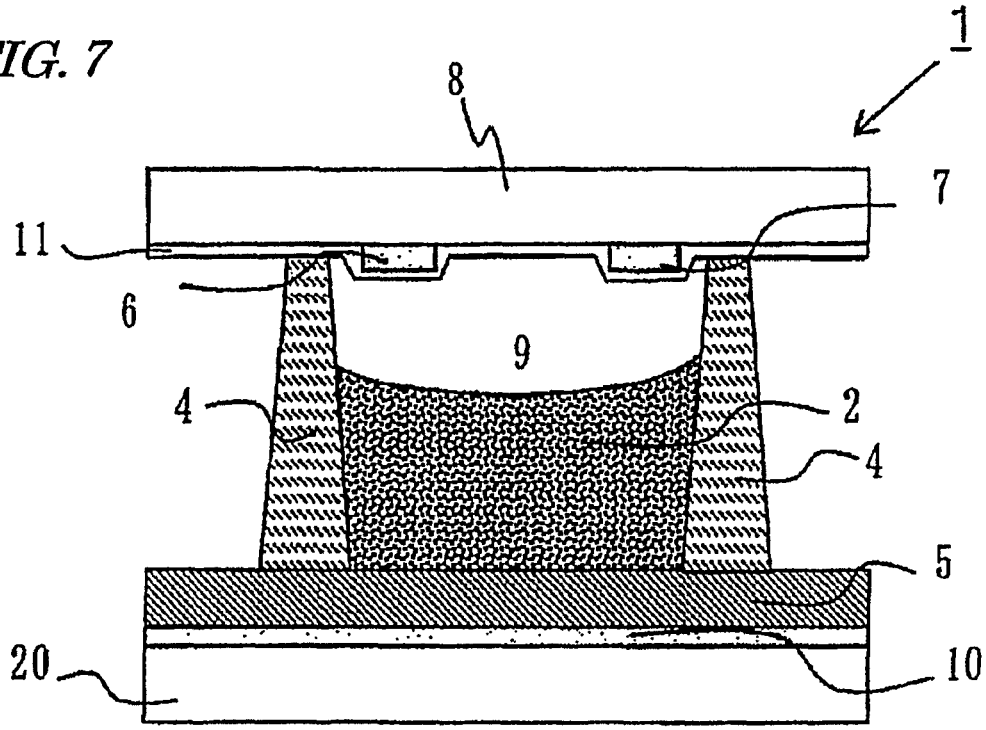
FIG. 7 is a cross-sectional view illustrating a light-emitting device according to a third preferred embodiment of the present invention.
Figure 8:
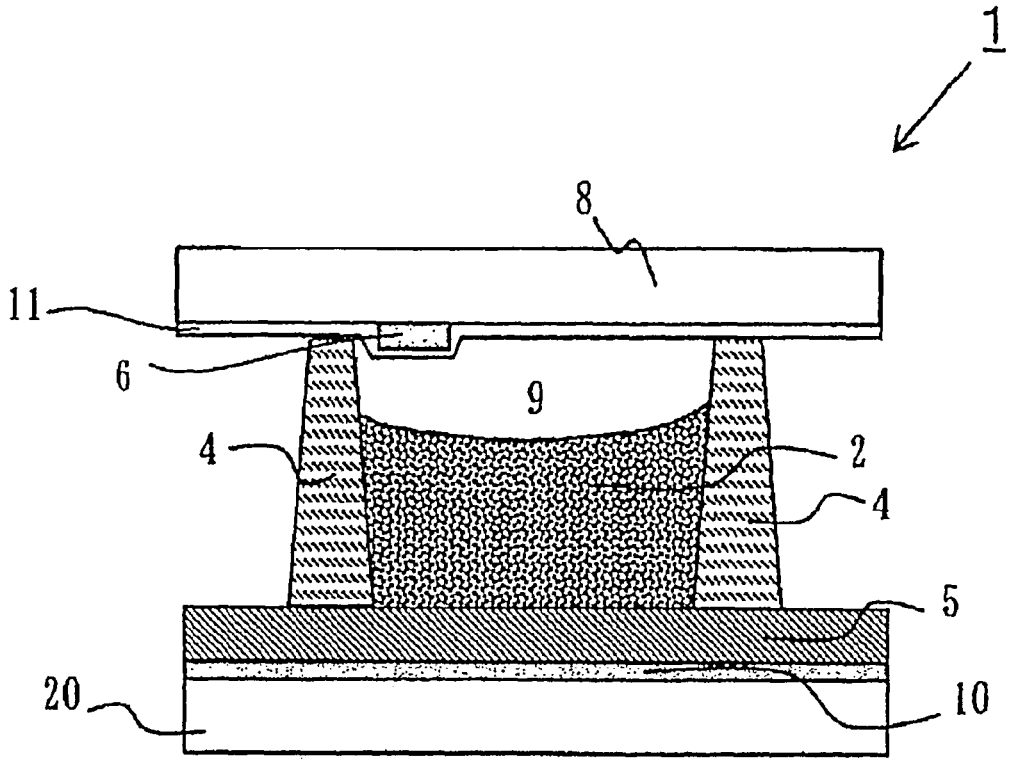
FIG. 8 is a cross-sectional view illustrating a light-emitting device according to a fourth preferred embodiment of the present invention.

In this manner, the light-emitting device 1 of the first preferred embodiment is obtained. However, if a light-emitting device is fabricated with only the first electrode 6 arranged on the light-transmitting substrate 8, a light-emitting device 1 according to a second preferred embodiment of the present invention shown in FIG. 6 is obtained. On the light-transmitting substrate 8 on which the first electrode 6 or the second electrode 7 has been formed, a thick film of dielectric paste is applied and then thermally treated in the air to form a dielectric layer. Next, if MgO is sputtered on the dielectric layer to form an MgO layer that covers the first electrode 6 or the second electrode 7, then a light-emitting devices 1 according to a third or fourth preferred embodiment of the present invention shown in FIG. 7 or 8 is obtained. To form the insulating layer 11, a mixture of 90 wt % of thick film of dielectric paste and 10 wt % of MgO powder may be applied and baked at a temperature of 500° C. to 600° C. in the air. The thickness of the insulating layer 11 is defined within the range of 0.1 μm to 30 μm. The insulating layer 11 serves as an electrical discharge protective coating for the electrodes. If the insulating layer 11 had a thickness of less than 0.1 μm, the electrodes 6 and 7 might be etched away by the electrical discharge and could deteriorate rapidly. On the other hand, if the thickness exceeded 30 μm, then the electrical discharge voltage would become too high to maintain sufficient luminous efficacy.

In the preferred embodiments described above, when the emitter 2 is formed, a paste is prepared based on a powder of fluorescent particles with an organic binder or an organic solvent added thereto if necessary. However, by changing those materials or heat treatment conditions, a porous emitter 2 can be obtained eventually. Specifically, concerning the heat treatment conditions, if a heat resistant ceramic plate is used as the lower substrate 20, then the heat treatment can be carried out in a relatively broad temperature range of 400° C. to 600° C. If a paste is prepared by adding the organic binder or organic solvent mentioned above, then a high temperature heat treatment should be carried out in the air, and the luminance characteristics would vary easily due to oxidation of the fluorescent particles, which is a problem. Specifically, $BaMgAl_{10}O_{17}$: $Eu^{2+}$, for example, emits blue light when excited by $Eu^{2+}$ as the center of emission. However, if $Eu^{2+}$ changed into $Eu^{3+}$ due to oxidation during the heat treatment, then red light would be emitted. That is why as for the emitter 2, it would be not only more beneficial in terms of luminance characteristic but also more economical, too, to use a paste, prepared by adding a colloidal silica aqueous solution of an inorganic binder instead of the organic binder, and then dry it at a temperature of 120° C. to 150° C. In the preferred embodiments described above, the porosity of the emitter 2 is at least 10% and most preferably 30% to 70%. If the porosity were less than 10% (i.e., if the emitter could no longer be called "porous"), then the emission phenomenon itself would be affected a little but the creeping discharge could no longer be sustained for a sufficiently long time inside the emitter 2. As a result, the resultant luminous efficacy would drop significantly compared to that of a porous emitter.

Next, it will be described with reference to FIG. 1 exactly how this light-emitting device 1 emits light. As shown in FIG. 1, an AC electric field is applied between the first electrode 6 and the second electrode 7 to drive the light-emitting device 1. In various preferred embodiments of the present invention, the magnitudes of capacitances produced by the respective members are in the order of: First insulator 4 or second insulator 5>Emitter 2>Gas layer 9. Therefore, if an electric field is applied to this light-emitting device, the values of the voltages applied to these layers, each of which is approximately proportional to the inverse of its associated capacitance, are in the order of: First insulator 4 or second insulator 5<Emitter 2<Gas layer 9. That is why this light-emitting device 1 should emit light in the following manner. First, an electric field is applied between the first electrode 6 and the second electrode 7. At this point in time, an electric field, higher than the dielectric breakdown voltage, is applied to the gas layer 9, where dielectric breakdown and electrical discharge are produced. In this case, the electrical discharge is produced where the cathode electrode, gas layer 9 and first insulator 4 are in contact with each other, and a great many electrons are emitted from the cathode electrode. Next, the emitted electrons collide against oxygen atoms and nitrogen atoms in the air in the gas layer 9, thereby producing ultraviolet radiation with a wavelength of 300 nm to 430 nm. Also, as capacitance is proportional to dielectric constant, a greater percentage of electrons would migrate on the surfaces of the first insulator 4 and the second insulator 5 with low impedances. Likewise, the percentage of electrons migrating on the surface or inside of the emitter 2 also increases. As a result, the emitted electrons also collide against the emitter 2. These electrons are accelerated by the electric field to produce ultraviolet radiation. Meanwhile, some of those electrons collide with the fluorescent particles to excite the centers of emission. If the emitter 2 is porous, creeping discharge is generated repeatedly using its voids. Consequently, the electrons are further accelerated to produce ultraviolet radiation, while some of them collide with the fluorescent particles to excite the centers of emission. Thereafter, the electrons are absorbed into the anode electrode. Light should be emitted by such concurrent phenomena of ultraviolet excitation and electron excitation. By applying an AC electric field to the third electrode 10 and controlling the electric field, the electrical discharge start voltage value and the number of electrons colliding with the emitter 2 can be controlled.

As an alternative preferred embodiment, a light-emitting device 1, in which only the first electrode 6 and a third electrode 10 are arranged, will be described with reference to FIGS. 6 and 8. Other than the arrangement of those electrodes, a light-emitting device is fabricated on the same conditions as those adopted in the preferred embodiments described above. When an AC electric field is applied between the first electrode 6 and third electrode 10 to drive the light-emitting device 1, an electric field that is equal to or higher than a dielectric breakdown voltage is applied to the gas layer 9, thereby producing dielectric breakdown and electrical discharge. In this case, the electrical discharge starts where the first electrode 6, gas layer 9 and first insulator 4 are in contact with each other, and electrons are emitted from the first electrode 6. Next, the emitted electrons collide with oxygen atoms and nitrogen atoms in air in the gas layer 9, thereby producing ultraviolet radiation with a wavelength of 300 nm to 430 nm. Also, since the first electrode 6 and third electrode 10 are arranged with the emitter 2 interposed between them, the percentage of electrons migrating on the surface or inside of the emitter 2 also increases. As a result, the emitted electrons also collide against the emitter 2. These electrons are accelerated by the electric field to produce ultraviolet radiation. Meanwhile, some of those electrons collide with the fluorescent particles to excite the centers of emission. If the emitter is porous, creeping discharge is generated repeatedly using its voids and the centers of emission are excited at higher rates. Thereafter, the electrons are absorbed into the third electrode 10. Light should be emitted by such concurrent phenomena of ultraviolet excitation and electron excitation.

By changing the waveforms of the AC electric field to be applied from a sine wave or a saw-tooth wave into a rectangular wave or by increasing the frequency from several tens of Hz to several thousands of Hz, the emission of electrons is activated very much and the luminance increases.

According to the present invention, by increasing the average thickness of the emitter 2 with respect to that of the gas layer 9 in each cell, the luminance is increased by a different light emission mechanism from that of a PDP. In other words, according to the present invention, the ratio of the volume of the emitter 2 to the total volume of the gas layer 9 and the emitter 2 combined in each cell is defined to be greater than 0.5 but less than 1. The meaning of this setting may be explained as follows using a cross-sectional view such as that shown in FIG. 6.

Supposing the first insulator 4 is extended to reach the light-transmitting substrate 8 on a plane that is viewed perpendicularly to the surface of the second insulator 5 and that passes the center of the cell, the cross-sectional area of a range surrounded with the first and second insulators 4, 5 and the light-transmitting substrate 8 is identified by A1 and the cross-sectional area A2 of the emitter 2 is identified by A2. In that case, according to the present invention, the A2/A1 ratio is defined to be greater than 0.4 but less than 1 (preferably, greater than 0.5 but less than 1). The reason why the A2/A1 ratio is set within such a range will be described below.

In each of the preferred embodiments described above, the emission status was studied with the A2/A1 ratio of the area A1 of the emitter 2 to the area A2 of such a range surrounded with the first insulator 4, the second insulator 5 and light-transmitting substrate 8 changed. It should be noted that the light-transmitting substrate 8 refers herein to a substrate arranged at the outermost position of the light-emitting device, not to a light-transmitting film or layer covering the electrodes 6, 7. Specifically a plurality of light-emitting devices were provided. In each of those light-emitting devices, paste including the fluorescent particles described above was solidified as the emitter 2 by a screen-printing process such that the ratio of the area of the emitter 2 to a predetermined cross-sectional area became 3%, 5%, 10%, 20%, 35%, 40%, 55%, 65%, 75%, 85% or 95%, and the luminance of each light-emitting device was measured under the following conditions.

Figure 9A:
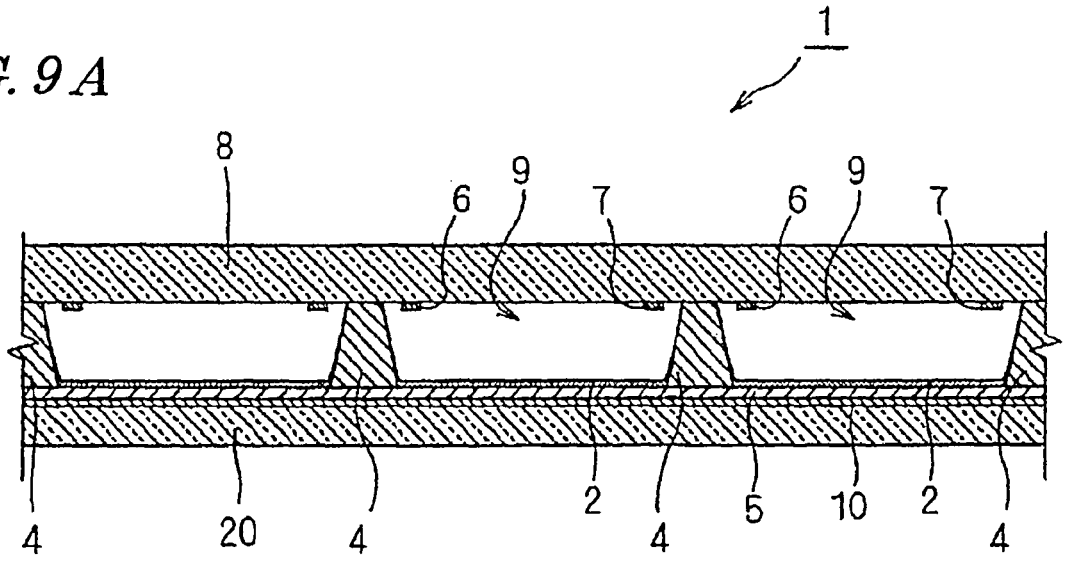
FIG. 9A is a cross-sectional view of the light-emitting device as viewed on the plane B-B shown in FIG. 1.

The first insulator 4 was formed so as to have different heights in the column and row directions, and the lower height of the first insulator 4 was defined to be 100 μm. If the emitter 2 had an A2/A1 ratio of 3%, 5% or 10% as shown in FIG. 9A, $BaMgAl_{10}O_{17}$: $Eu^{2+}$ (blue) fluorescent particles, which had a wide excitation spectrum in the wavelength range of 200 nm to 400 nm, for example, were supposed to be used and the gas layer 9 was supposed to be the air. The electrical discharge spectrum of the air fell with an ultraviolet range corresponding to the wavelength range of 300 nm to 430 nm, and the fluorescent particles described above emitted blue light as a result of the ultraviolet excitation and the electron excitation. In this case, the emission of light would have been produced mainly by the ultraviolet excitation. When the gas layer 9 was replaced with argon gas, the luminance dropped significantly. This is probably because the electrical discharge spectrum of the argon gas, in which the light was emitted, was in the wavelength range of 690 nm to 850 nm, and therefore, the fluorescent particles emitted light not by the ultraviolet excitation but mostly by the electron excitation, thus decreasing the luminance. Also, when the area of the emitter 2 were less than 3%, electrical discharge would be produced on the surface of the second insulator 5 to changes the chromaticity, which is not preferable.

Figure 9B:
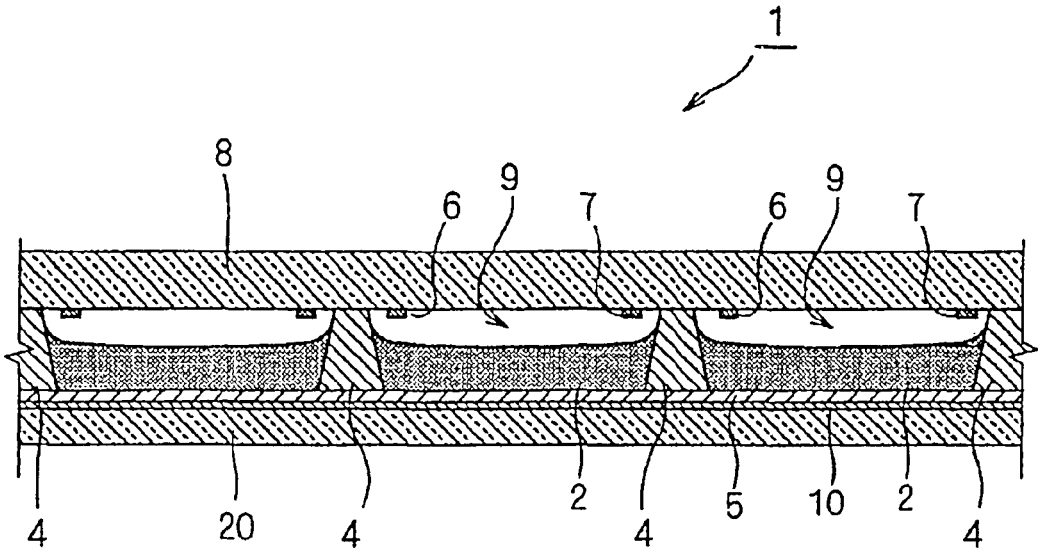
FIG. 9B is another cross-sectional view of the light-emitting device as viewed on the plane B-B shown in FIG. 1.
Figure 1:
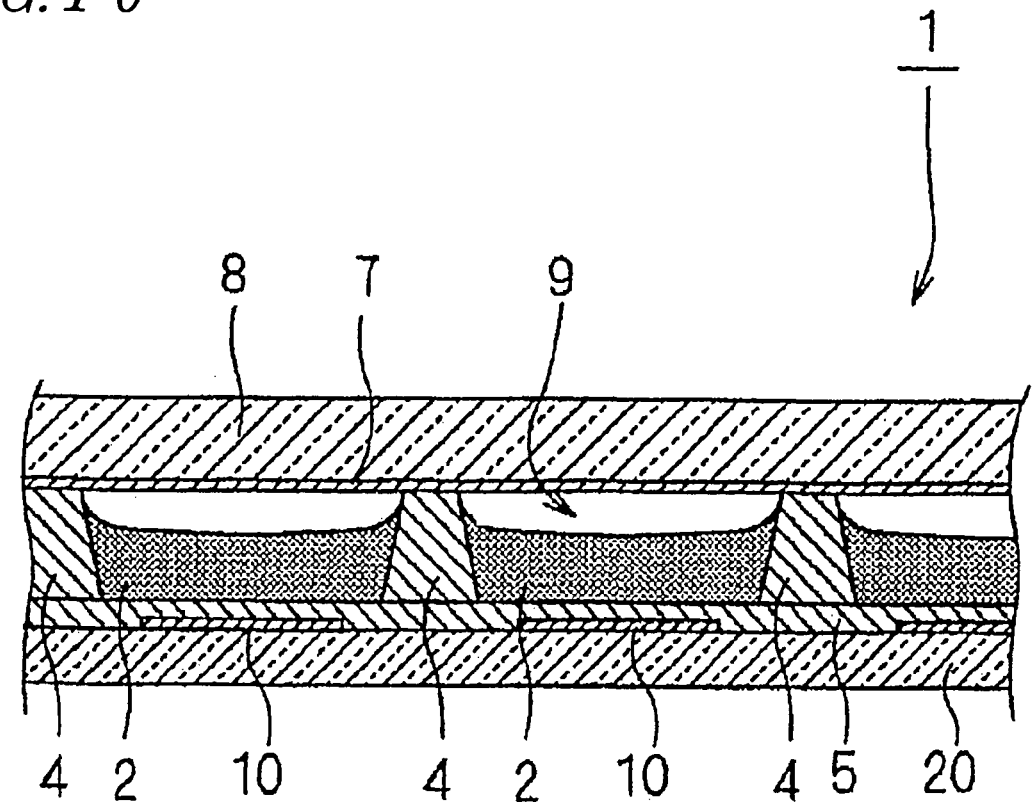
Figure 1:
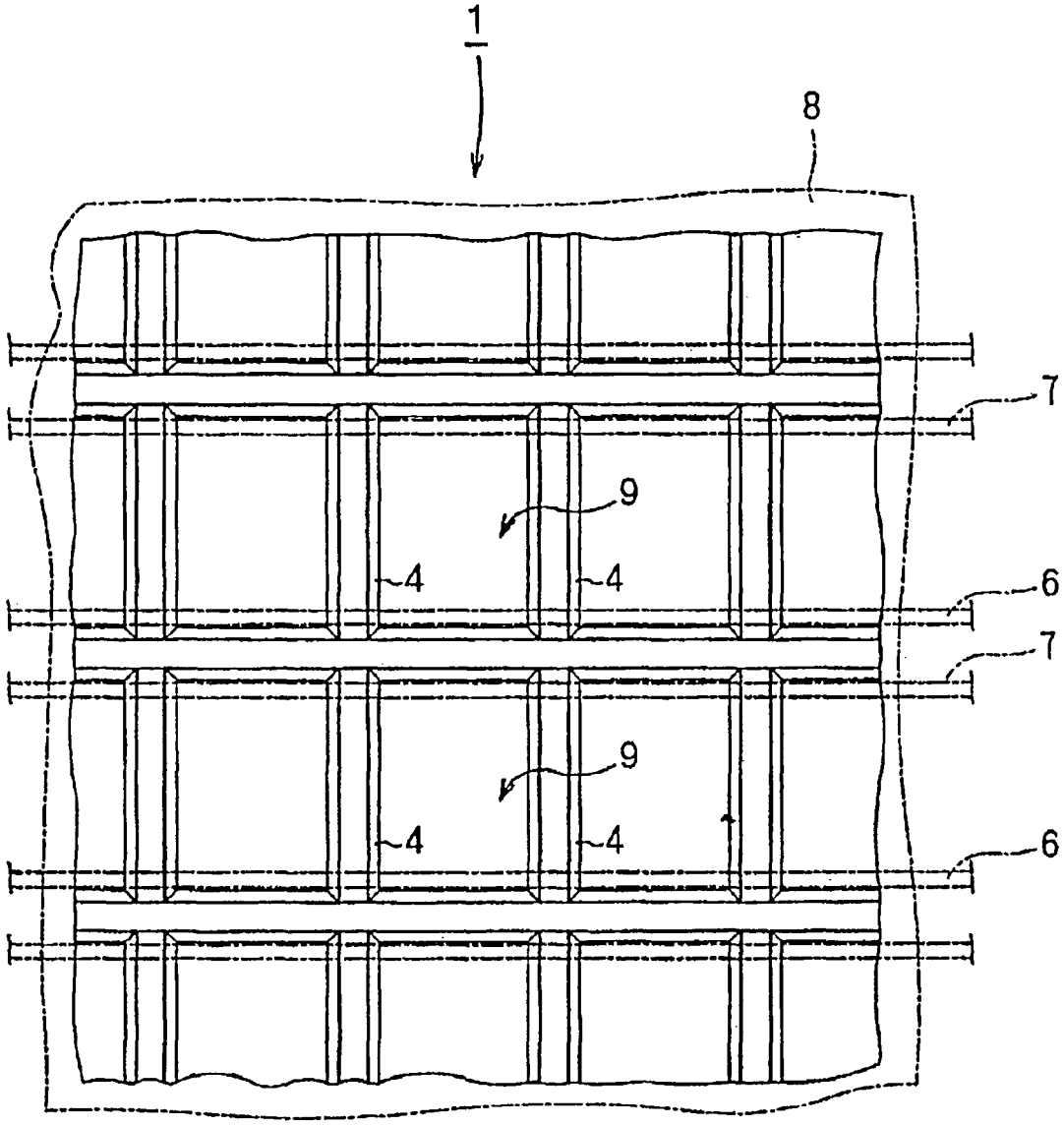

Conversely, if the A2/A1 ratio is 20%, 35%, 40%, 55%, 65% or 75%, the fluorescent particles were excited as a result of both the ultraviolet excitation and electron excitation and the luminance increased, so did the brightness. However, when the A2/A1 ratio was less than 40%, the luminance did not increase sufficiently. Also, if the emitter 2 was porous, the luminance further increased at 55%, 65% and 75%, i.e., when the A2/A1 ratio was more than 40% to less than 80% as shown in FIG. 9B. This is probably because the emitter 2 was thick enough to produce creeping discharge more easily even inside the emitter 2 and the ratio of collision between the electrons and emitter 2 would have increased. When the gas layer 9 was replaced with argon gas as in the example described above, the luminance decreased slightly but light was emitted as a result of the electron excitation. Consequently, the brightness was almost doubled compared to the situation where the A2/A1 ratio was 3%, 5% or 10%. Furthermore, when the A2/A1 ratio was 85% or 95%, the luminance slightly decreased. Even if the gas layer 9 was replaced with argon gas, the luminance hardly changed compared to the situation where the atmosphere was the air. This is probably because the electrical discharge space was so small as to emit light mostly by the electron excitation.

Thus, it was discovered that to increase the luminance by getting light emitted from the emitter 2 based on the radiation produced by the electrical discharge in the gas layer 9 and producing light through the electron excitation in the emitter 2, the A2/A1 ratio should be set greater than 40%. Also, if there was no gas layer 9 at all, sufficient light could not be produced. For these reasons, the A2/A1 ratio needs to be greater than 0.4 but less than 1. A more preferable lower limit of the A2/A1 ratio may be defined as more than 0.5 and may even be more than 0.6.

As described above, the light-emitting device of this preferred embodiment can emit light by utilizing both ultraviolet excitation and electron excitation, and therefore, the cross-sectional area of the emitter 2 can account for a greater percentage, which is advantageous. On top of that, the third electrode 10 is arranged and the electric field is controlled, thus producing dielectric breakdown of the gas more easily with an electric field applied between the first electrode 6 and the second electrode 7. Also, as capacitance is proportional to dielectric constant, a greater percentage of electrons would migrate on the surfaces of the first and second insulators with low impedances. Likewise, the percentage of electrons migrating on the surface or inside of the emitter 2 also increases. As a result, the emitted electrons also collide against the emitter 2. Also, the electric field applied to the third electrode 10 may be controlled such that a lot of electrons will collide with, and penetrate deep into, the emitter 2 or that electrons will be emitted so as not to collide with the emitter 2.

In the preferred embodiments described above, the device is driven in the air. However, the present inventors confirmed that light was also emitted in a similar manner even in oxygen gas alone, nitrogen gas alone, a mixture of oxygen and nitrogen at any mixture ratio, or in a gas with a reduced pressure. We also confirmed that light was also emitted in a similar manner even when a mixture in which 2% or less of xenon gas was added to the various gases mentioned above was used.

In the light-emitting device of the preferred embodiments described above, the emitter is formed by a thick film deposition process. That is why the thickness of each layer being deposited does not have to be controlled so strictly as in fabricating a conventional light-emitting device. In addition, since no vacuum system or carrier multiplication layer is needed, the structure can be simplified and the manufacturing and patterning processing can be done easily, too. In an emitter with a porous structure, not only its surface as in ordinary fluorescent material but also the entire emitter can emit light uniformly because impinging electrons reach deep inside of the emitter with a porous structure. Furthermore, compared to the emission of light by a fluorescent material using ultraviolet radiation as is done by a plasma display, the luminous efficacy is much higher. As a result, a light-emitting device that would have relatively low power dissipation when used in a huge-screen display and that has such a structure as to realize high definition relatively easily can be provided. By arranging a first insulator that functions as an electrical discharge separation means as a barrier surrounding the emitter on all four sides, the crosstalk of the light emitted can be avoided easily.

INDUSTRIAL APPLICABILITY

In a light-emitting device according to the present invention, the emitter can be formed by a thick film deposition process, for example. That is why the thickness of each layer being deposited does not have to be controlled so strictly as in fabricating a conventional light-emitting device. In addition, since no vacuum system or carrier multiplication layer is needed, the structure can be simplified and the manufacturing and patterning processes can be done easily, too. Furthermore, since the light-emitting device achieves higher luminous efficacy than a PDP, this light-emitting device can be used particularly effectively in various types of displays, among other things.

The invention claimed is:

1. A light-emitting device comprising: a first insulator, including a plurality of portions that are arranged so as to face each other; an emitter, which includes fluorescent particles and which is arranged in a space that is defined by those portions of the first insulator, wherein the emitter has a porous surface layer and is configured to emit light by a creeping discharge of the emitter, the creeping discharge being an electrical discharge that is produced in the porous surface layer of the emitter; a second insulator, which functions as a base for the first insulator and the emitter; a plurality of electrodes to generate an electric field in the space and the porous surface layer of the emitter; and a substrate, which faces the second insulator with the emitter interposed between them, wherein the ratio A2/A1 of the cross-sectional area A2 of the emitter to the cross-sectional area A1 of a range surrounded with the first and second insulators and the substrate is greater than 0.4 but less than 1, the cross-sectional area A2 of the emitter and the cross-sectional area A1 of the range being on a plane that is perpendicular to the surface of the second insulator and that passes the center of the space.

2. The light-emitting device of claim 1, wherein the first and second insulators are made of the same material.

3. The light-emitting device of claim 1, wherein the first and second insulators have a dielectric constant of 5 or more.

4. The light-emitting device of claim 1, wherein one of the first and second insulators has a dielectric constant of 30 or more and the other insulator has a dielectric constant of 5 or more.

5. The light-emitting device of claim 1, wherein the first and second insulators are made of either a glass material or a mixture of a glass material and a metal oxide.

6. The light-emitting device of claim 1, wherein the electrodes include a front-side electrode and a backside electrode that are arranged on two opposite sides of the emitter, the front-side electrode being covered with an insulating layer.

7. The light-emitting device of claim 6, wherein the insulating layer includes an alkaline earth metal oxide.

8. The light-emitting device of claim 1, wherein the entire emitter is porous.

9. The light-emitting device of claim 1, wherein a layer of a gas is present between the emitter and the substrate.

10. The light-emitting device of claim 9, wherein the gas includes at least one of oxygen and nitrogen.

11. The light-emitting device of claim 10, wherein the at least one of oxygen and nitrogen accounts for at least 1 volume % of the gas.

12. The light-emitting device of claim 1, wherein the gas is a mixture including xenon, which accounts for 2 volume % or less of the mixture.

13. The light-emitting device of claim 9, wherein the gas has a pressure of $5\times10^3$ Pa to $9\times10^4$ Pa.

14. The light-emitting device of claim 9, wherein at the center of the space, the average thickness of the gas layer is smaller than that of the emitter.

15. The light-emitting device of claim 1, wherein each said portion of the first insulator has a rib structure that protrudes from the second insulator toward the substrate.

16. The light-emitting device of claim 1, wherein those portions of the first insulator define barriers that divide a plurality of self-emitting cells from each other between the second insulator and the substrate.

17. The light-emitting device of claim 16, wherein a gap is left between the barriers and the substrate.

* * * * *